United States Patent [19]

Marshall et al.

[11] 4,060,297

[45] Nov. 29, 1977

[54] PLUG CAP

[76] Inventors: Bruce H. Marshall, 2256 W. Arthur Ave., Chicago, Ill. 60645; Henry E. Blenner, 1515 E. Central Road, Arlington Heights, Ill. 60005

[21] Appl. No.: 745,531

[22] Filed: Nov. 29, 1976

[51] Int. Cl.[2] ..... H01R 13/44

[52] U.S. Cl. ..... 339/37

[58] Field of Search ..... 339/37, 38, 39, 36, 339/75 P, 82, 91 R

[56] References Cited

U.S. PATENT DOCUMENTS

| | | | |
|---|---|---|---|
| 2,654,073 | 9/1953 | Katz | 339/37 |
| 2,732,531 | 1/1956 | Janowiec | 339/91 R |
| 2,733,416 | 1/1956 | Evalt | 339/37 |
| 2,844,805 | 7/1958 | Darrell | 339/37 |
| 3,192,499 | 6/1965 | West | 339/91 R |

*Primary Examiner*—Roy Lake
*Assistant Examiner*—Neil Abrams
*Attorney, Agent, or Firm*—Vogel, Dithmar, Stotland, Stratman & Levy

[57] ABSTRACT

The plug cap has a body with a pair of spaced-apart channels for receiving the prongs of a male electrical plug. A pair of legs are pivotally mounted on the body and are movable between locking and unlocking positions. Each leg carries a finger which enters the aperture of the prong on the associated electrical plug when the legs are in the locking positions thereof.

13 Claims, 12 Drawing Figures

PLUG CAP

BACKGROUND OF THE INVENTION

This invention relates to a cap that is used in association with a male electrical plug to prevent insertion thereof into an electrical receptacle by a child. There are a number of prior U.S. patents disclosing caps of this general character such as U.S. Pat. Nos. 2,733,416 to Evalt, 2,654,073 to Katz, 2,664,734 to McEneaney, 2,884,805 to Durrell, 3,416,123 to Husebo, 3,422,389 to Husebo, 3,543,544 to Efston, and 3,781,913 to Liburdi. However, except for the device disclosed in the Liburdi patent, all are more complicated than is necessary to prevent a child from inserting an electrical plug into an outlet. Thus they are too expensive to appeal to this particular market. Furthermore, they are all difficult to use since they require use of a key or some tool to be attached and detached. Also, some of these prior art caps have separable parts making it easier to lose or misplace a part.

SUMMARY OF THE INVENTION

It is an important object of the present invention to provide a plug cap which is inexpensive to make yet when attached to a male electrical plug, cannot be removed by a small child.

Another object is to provide a cap which can be easily and quickly attached and detached by an adult, yet cannot be attached and detached by a small child.

Another object is to provide a plug cap which can be attached to a plug and detached therefrom without the need of a key or other tool, but rather can be taken off by an adult with the use of his fingers.

Another object is to provide a plug cap which is unitary, and does not have separable parts.

In summary, there is provided a plug cap for use in association with a male electrical plug having two spacedapart prongs, respectively with apertures near the ends thereof, the plug cap comprising a body having a pair of spaced-apart channels therein respectively to receive the prongs of the male electrical plug, a pair of legs pivotally mounted on the body and movable between a locking position respectively alongside the channels and an unlocking position respectively away from the channels, and a pair of fingers respectively carried by the legs and located thereon to enter the apertures of the prongs when the legs are in the locking positions thereof and to be withdrawn from the apertures when the legs are in the unlocking positions thereof.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages, of the invention.

BRIEF DESCRIPTION OF THE DRAWINGS

For the purpose of facilitating an understanding of the invention, there is illustrated in the accompanying drawings, two preferred embodiments thereof, from an inspection of which, when considered in connection with the following description, the invention, its construction, and operation, and many of its advantages should be readily understood and appreciated.

DESCRIPTION OF THE PREFERRED EMBODIMENTS

Figure 1:
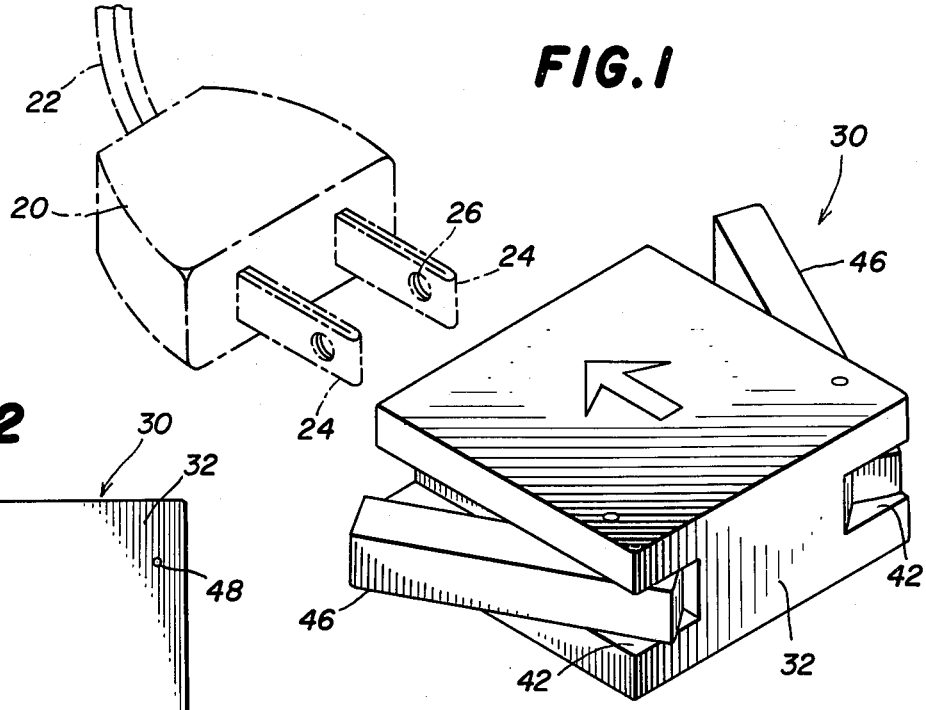
FIG. 1 is a perspective view, showing in phantom a male electrical plug being inserted into a plug cap incorporating the features of the present invention.
Figure 2:
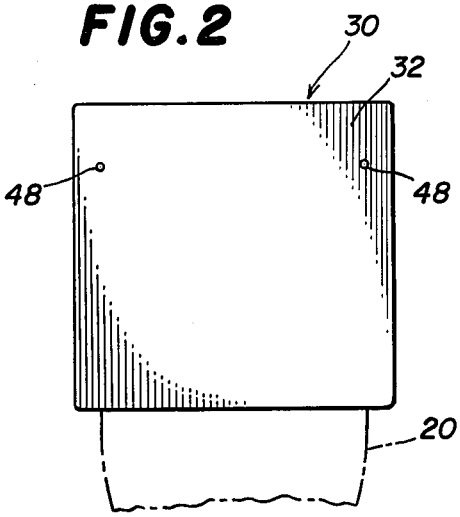
FIG. 2 is a plan view of the plug cap.
Figure 3:
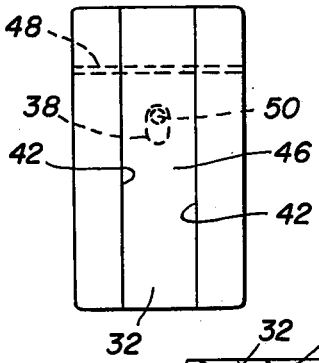
FIG. 3 is a side elevational view of the plug cap.
Figure 4:
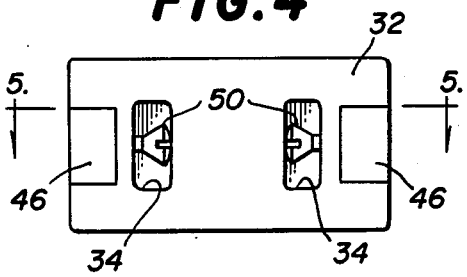
FIG. 4 is an end elevational view of the plug cap.
Figure 5:
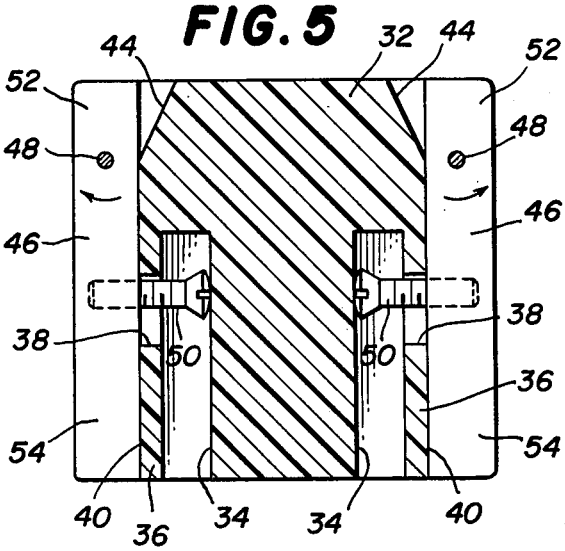
FIG. 5 is a view in vertical section, on an enlarged scale, taken along the line 5–5 of FIG. 4.

Turning now to the drawings, there is depicted in FIG. 1, a male electrical plug 20 adapted to be inserted into an electrical receptacle such as a wall outlet. The plug 20 is attached to the end of a cord 22 and has the usual pair of spaced apart prongs 24. As is standard, each prong 24 has a hole 26 near its end. It is desirable in certain instances to prevent a child from inserting the plug 20 into a wall outlet. To that end, there is provided a plug cap 30 incorporating the features of the present invention. It includes a solid plastic body 32 generally rectangular in cross section. A pair of channels 34 in the body 32 are spaced apart the same distance as the prongs 24, and have lengths corresponding to the lengths of the prongs 24. A side of each channel 34 is defined by a wall 36, which has an opening 38 therein. In each side of the body 32 is a recess 40, whereby the body has an H-shaped cross section. Each recess 40 is defined by side surfaces 42. At one end of each recess 40 is a slanted stop surface 44.

Figure 6:
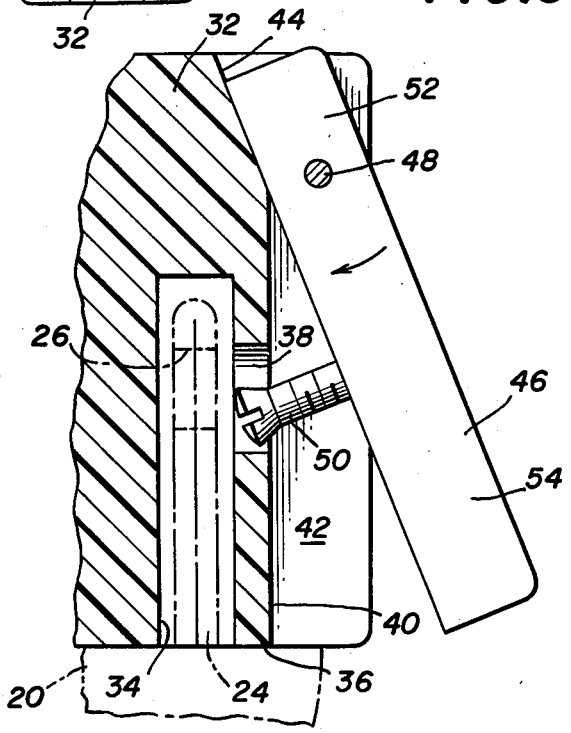
FIG. 6 is a view on an enlarged scale of the righthand portion of FIG. 5 with a prong shown in phantom and with the locking leg shown in its unlocking position.
Figure 7:
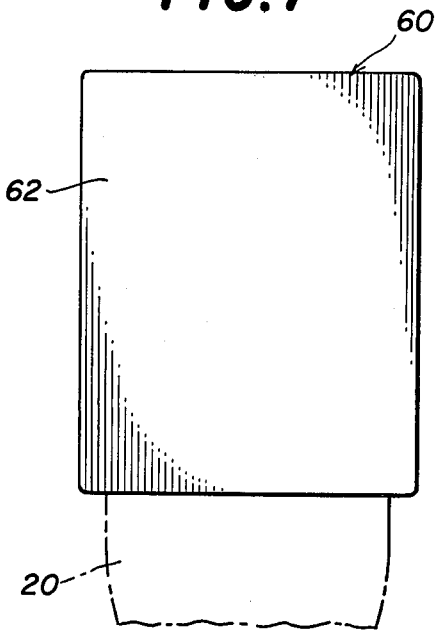
FIG. 7 is a plan view of a second embodiment of the present invention.
Figure 8:
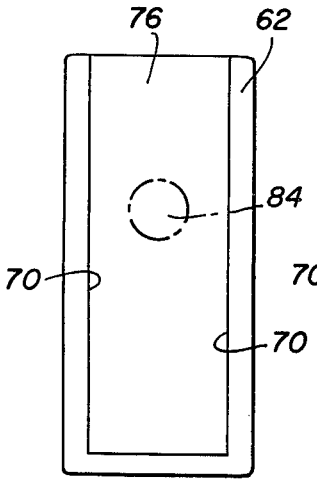
FIG. 8 is a side elevational view of the cap depicted in FIG. 7.
Figure 11:
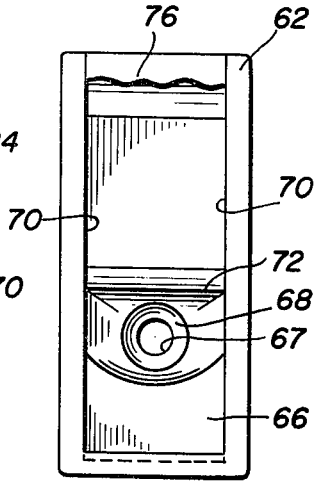
FIG. 11 is a view like FIG. 8, but with the locking leg having been removed.
Figure 9:
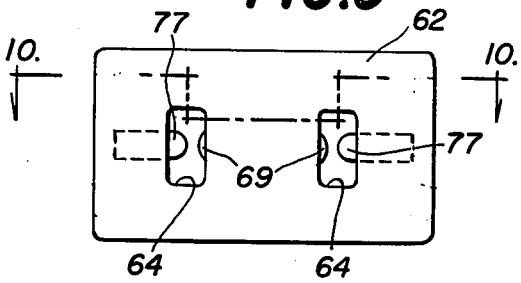
FIG. 9 is an end elevation view.

The cap 30 further includes a pair of legs 46 pivotally mounted to the body 32 respectively by means of pins 48. Each leg 46 is movable between a locking position within the recess 40, and an unlocking position outside the recess as shown in FIG. 6. Mounted on each leg 46 is an inwardly directed finger 50. The finger 50, in the embodiment shown, is a screw threaded into each leg 46. The finger 50 is located such that when the associated leg 46 is pivoted toward the body 32, it enters the associated hole 38 and channel 34, and when pivoted away from the body 32, it is withdrawn from the associated channel 34 and opening 38. The parts are dimensioned such that when the prongs 24 of the plug 20 are inserted into the channels 34, the legs 46 can be pivoted to cause the fingers 50 to enter the prong holes 26.

The pin divides each leg into a first section 52 and a second section 54. When the forefinger and thumb respectively engage the outer surfaces of the first sections 52 of the legs 46 and are pushed toward one another, the fingers 50 carried by the second sections 54 are withdrawn, whereby the cap 30 is in an unlocking position and the plug 20 may be inserted therein. By then drawing together the sections 54, the pins 48 are caused to enter the openings 38 and the holes 26 in the prongs 24. In this condition, the plug 20 cannot be inserted into an electrical receptacle. The side surfaces 42 frictionally engage the legs 46 and therefore constitute a retaining means to hold the legs 46 in their locking positions. It would be quite difficult for a small child to unlock these legs 46. However, an adult can do so, without tools, simply by grasping the first sections 52, as described above, causing the legs 46 to pivot outwardly until the sections 52 abut against the stop surfaces 44.

A second embodiment of the invention, depicted in FIGS. 7 to 12, is a plug cap 60 incorporating the features of the present invention. It includes a solid plastic body 62 generally rectangular in cross section and having a pair of channels 64 spaced apart the same distance as the prongs 24, the lengths of the channels corresponding to the lengths of the prongs 24. One side of each of the channels 64 is defined by a wall 66, which has an opening 67 therein communicating with a conically shaped guide 68. A nib 69 is located in each channel 64 on the body 62 and laterally aligned with the associated opening 67. The body 62 has in each recess 70 a projection with an edge defining a fulcrum 72. Formed at the bottom of each recess 70 is a lip which defines a keeper 74.

Figure 12:
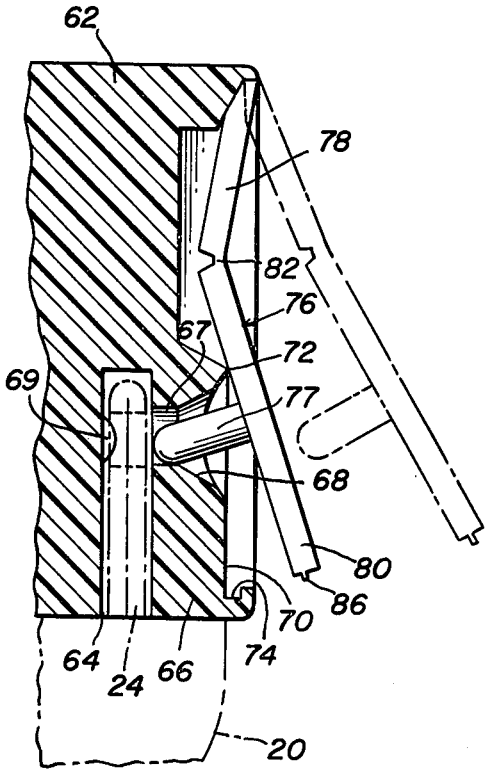
FIG. 12 is a view of the right-hand portion of FIG. 10 showing a prong in phantom, and the locking leg in two stages of its unlocking position.
Figure 10:
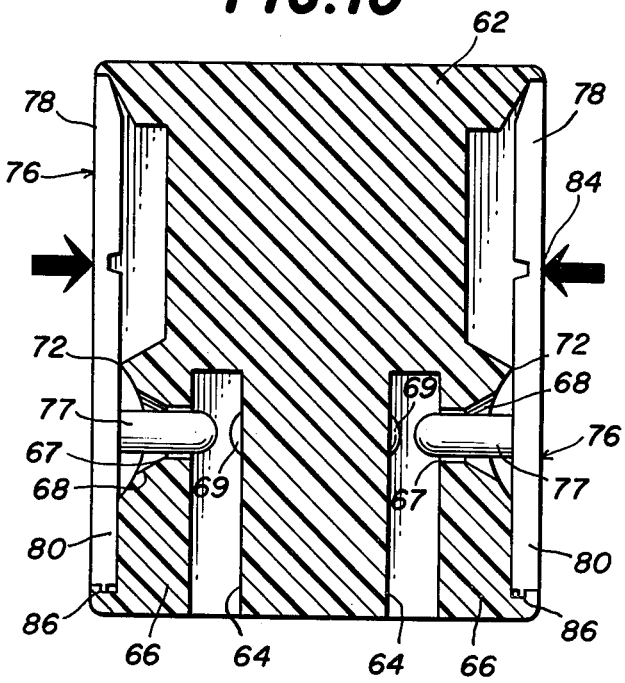
FIG. 10 is a view in vertical section on an enlarged scale taken along the line 10–10 of FIG. 9.

The cap 60 further includes a pair of legs 76 integral with the body 62 and pivotally mounted thereon. These legs 76 are movable between a locking position within the recesses 70 respectively, and an unlocking position wherein these legs are pivoted outwardly, as shown in FIG. 12. On each leg 76 is an inwardly directed finger 77 which may be integrally formed thereon. Each finger 77 is located such that when the associated leg 76 is pivoted toward the body 62, the finger 77 is guided by means of the guide 68, through the opening 67 in facing relationship with the associated nib 69. When the legs 76 are pivoted away from each other, the fingers 77 are withdrawn from the channels 64 and the openings 67. The parts are dimensioned such that when the prongs 24 of the plug 20 are inserted into the channels 64, the fingers 77 will enter the holes 26.

Each leg 76 is integral and has a first section 78 and a second section 80 joined by a hinge 82, which sections are dimensioned such that the fulcrum 72 is opposite the second section 80. The finger 77 is located on the second section 80 between the fulcrum and the free end of the leg 76. A lip 86 is provided on the free end of the leg 76. When the region of the leg 76 near the associated hinge 82 is pushed inwardly the associated section 80 is caused to be pivoted about the fulcrum 72 causing the associated lip 86 to snap out of its keeper 74. This is the position represented by the leg 76 shown in solid line. When the leg 76 may be grasped and pivoted further, to withdraw the finger 77 from the associated hole 26 in the plug prong 24. Now the leg 76 is in its unlocking position as represented by the phantom line in FIG. 12. The plug 20 may then be inserted. By drawing together the sections 78, the fingers 77 are caused respectively to enter the openings 67 in the holes 26 and the prongs 24 and the lips 86 snap into the keepers 74. In this condition, the plug 20 cannot be inserted into an electrical receptacle, and it would be quite difficult for a small child to unlock these legs 76. However, an adult can do so, without tools, simply by pushing on the hinges 82 in the manner described above.

What have been described therefore are two embodiments of an improved plug cap which can be applied to an electrical plug to prevent insertion thereof by a small child, and cannot be readily removed by the child. However, the two embodiments of the cap described are readily removable by an adult without the use of a tool.

We claim:

1. A plug cap for use in association with a male electrical plug having two spaced-apart prongs, respectively with apertures near the ends thereof, said plug cap comprising a body having a pair of spaced-apart channels therein respectively to receive the prongs of the male electrical plug, said body further having therein a pair of outwardly facing, oppositely directed recesses, a pair of legs pivotally mounted on said body and movable between a locking position respectively in said recesses and respectively alongside said channels and an unlocking position respectively out of said recesses and respectively away from said channels, and a pair of fingers respectively carried by said legs and located thereon respectively to enter the apertures of the prongs when the legs are in the locking positions thereof and to be withdrawn from the apertures when the legs are in the unlocking positions thereof.

2. The plug cap set forth in claim 1, wherein each recess is U-shaped in cross section.

3. The plug cap set forth in claim 1, wherein said body has a pair of separating walls respectively between said channels and said recesses, each of said walls having an opening therein through which the associated finger is movable.

4. The plug cap set forth in claim 1, wherein said body has a pair of stop surfaces thereon to limit movement of said legs respectively away from said body.

5. The plug cap of claim 1, wherein said legs are integral with said body.

6. The plug cap set forth in claim 1, wherein each of said legs has hingedly connected first and second sections, one end of said first section being pivotally mounted to said body, said body having fulcrum means opposite a region on said second section, an associated finger being on said second section between said region and the free end thereof, whereby pressure of the thumb and forefinger respectively in the regions of said hinges respectively simultaneously pivots said second sections of said legs about said fulcrum means to withdraw said fingers from the apertures.

7. The plug cap set forth in claim 1, wherein each of said legs is rigid and is pivotally mounted to said body at a point between the ends thereof, thereby defining first and second sections of said leg on each side of said point, said finger being located on said first section, said second sections respectively of said legs being simultaneously gripable respectively by the thumb and forefinger to be moved toward each other to place said legs in the unlocking positions thereof.

8. The plug cap set forth in claim 1, wherein said legs are held in said body in the locking positions thereof by means of substantial frictional engagement between said legs and said body.

9. The plug cap set forth in claim 1, wherein said body and said legs are formed of plastic.

10. The plug cap of claim 1, further comprising a pair of retaining means for respectively holding said legs in the locking positions thereof.

11. The plug cap set forth in claim 1, and further comprising a pair of retaining means respectively on the free ends of said legs.

12. The plug cap set forth in claim 1, and further comprising a pair of pins respectively pivotally connecting said legs to said body.

13. The plug cap set forth in claim 1, and further comprising a pair of nibs on said body and in said channels, said nibs respectively being aligned with said fingers in the locking positions of said legs and having a length to enter into the apertures of the prongs in the electrical plug.

* * * * *